US005645167A

United States Patent [19]

Conrad

[11] Patent Number: 5,645,167

[45] Date of Patent: Jul. 8, 1997

[54] PAINT BRUSH CONTAINER

[76] Inventor: Keith Conrad, 16 Wardpark Rd., Grand Island, N.Y. 14072

[21] Appl. No.: 707,203

[22] Filed: Aug. 30, 1996

[51] Int. Cl.[6] ..... B65D 83/10

[52] U.S. Cl. ..... 206/361; 206/1.5; 206/15.3; 220/324

[58] Field of Search ..... 206/361, 362.1–362.3, 206/15.2, 15.3, 234, 38, 1.5; 220/283, 281, 324

[56] References Cited

U.S. PATENT DOCUMENTS

| | | | |
|---|---|---|---|
| 1,869,753 | 8/1932 | Kamm | 206/361 |
| 1,872,827 | 8/1932 | Searles . | |
| 2,004,320 | 6/1935 | Hanson . | |
| 2,550,248 | 4/1951 | Holton . | |
| 2,610,731 | 9/1952 | Austin . | |
| 3,800,998 | 4/1974 | Gask . | |
| 4,098,430 | 7/1978 | Mattheis et al. | 220/283 |
| 4,423,811 | 1/1984 | Knapp . | |
| 4,606,456 | 8/1986 | Kaminski . | |
| 5,191,973 | 3/1993 | Shteynberg . | |
| 5,244,090 | 9/1993 | Keith . | |
| 5,363,959 | 11/1994 | Crosby et al. . | |
| 5,465,453 | 11/1995 | Landmeier | 206/361 |
| 5,540,363 | 7/1996 | Wilson | 206/361 |

*Primary Examiner*—Paul T. Sewell
*Assistant Examiner*—Luan K. Bui
*Attorney, Agent, or Firm*—Hodgson, Russ, Andrews, Woods & Goodyear LLP

[57] ABSTRACT

A paint brush container with improved fastener means comprises a pair of tray-shaped members connected together by a hinge. A fastener means for the trays comprises protrusions on one of them and mating openings provided through the other tray, where the length of the openings is longer than the width of the protrusions. As the hinge may wear and develop play, the trays may become out of their initial alignment. However, the extended length of the fastener openings easily receives the protrusions to provide a snap latch that maintains the container in the closed position.

6 Claims, 3 Drawing Sheets

PAINT BRUSH CONTAINER

BACKGROUND OF THE INVENTION

1. Field of the Invention

The present invention relates generally to the art of containers, and, in particular, to an improved thermoplastic container comprising two tray-shaped members connected by a living hinge and maintained in the closed position by two side snap latches. Such a container is particularly useful for housing a paint brush and the like.

2. Prior Art

Containers suitable for keeping and maintaining professional paint brushes in good working condition are known in the art. A typical state of the art device is shown by U.S. Pat. No. 4,423,811 to Knapp which discloses a container comprising two tray-shaped members connected together by a hinge for opening and closing the container. One of the trays is provided with cylindrical protrusions that are received in a closely-fit relationship in circular recesses provided in the other tray to serve as a closure means. One disadvantage of the Knapp container resides in the method of closing it; the closure means requires a user to press the protrusions into the recesses at each of the four corners of the trays. Another disadvantage of the Knapp device is that as the container wears and play develops in the hinge, the protrusions are not automatically in registry with the recesses. It then becomes necessary to first properly align and then mate the protrusions with the recesses, thus rendering it difficult to maintain the container in the closed position.

SUMMARY OF THE INVENTION

It is an object of the present invention to provide a paint brush container with an improved closure means that allows a user to close the container easily to lock it in the closed position, even after the living hinge begins to wear from repeated opening and closing events.

It is also an object of the present invention to provide a durable paint brush container having a hinge connecting two tray-shaped members that quickly and easily mate with each other to house a paint brush therein.

It is further an object of the present invention to provide an uncomplicated and easy to close paint brush container.

Briefly, these and other related objects in accordance with the present invention are accomplished by providing upper and lower tray-shaped members that are connected to each other by a living hinge. The upper and lower trays each have an inlet in their front panels. When the container is in the closed position, the two inlets form an opening for receiving the handle of a paint brush. Two snap latches form a fastener means for securing the trays in the closed position. The snap latches comprise protruding members disposed on the opposed side walls of one of the trays and mating openings disposed in the opposed side walls of the other tray. The length of the openings is somewhat longer than that of the width of the protruding members along the longitudinal axis of the container. This enables the openings to receive the protruding members to maintain the container in the closed position, even after play develops in the hinge and the trays no longer perfectly align with each other.

These and other aspects of the present invention will become more apparent to those skilled in the art by reference to the following description and to the appended drawings.

BRIEF DESCRIPTION OF THE DRAWING FIGURES

Figure 7:
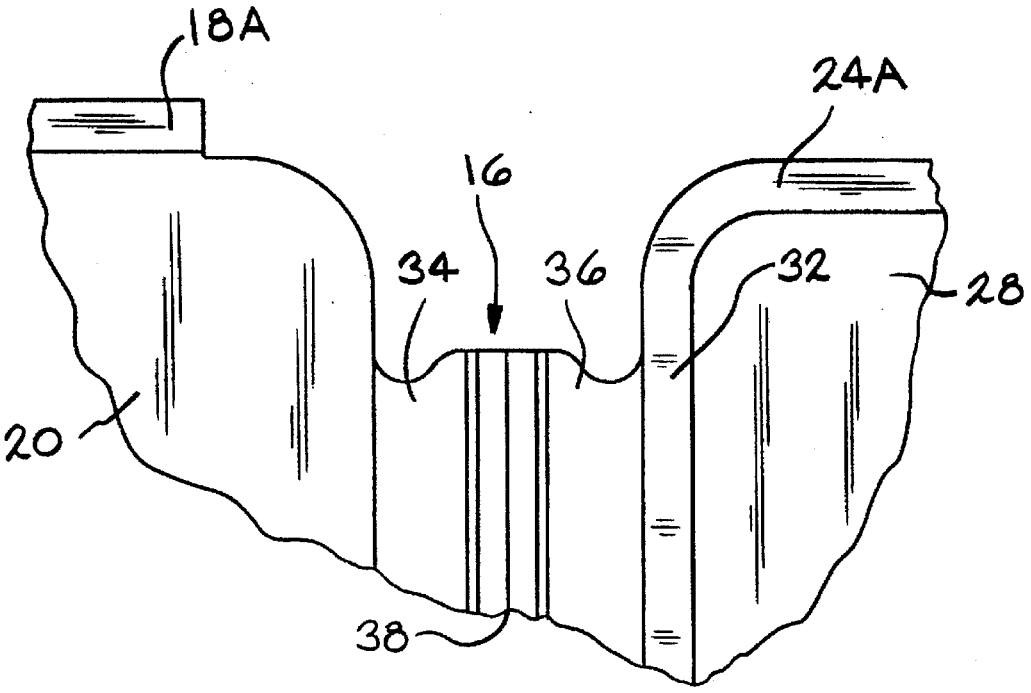

FIG. 7 is a fragmentary view of the inside of the container 10 in its fully opened position showing a hinge 16 connecting upper and lower trays 12 and 14.

DETAILED DESCRIPTION OF THE PREFERRED EMBODIMENT

Figure 1:
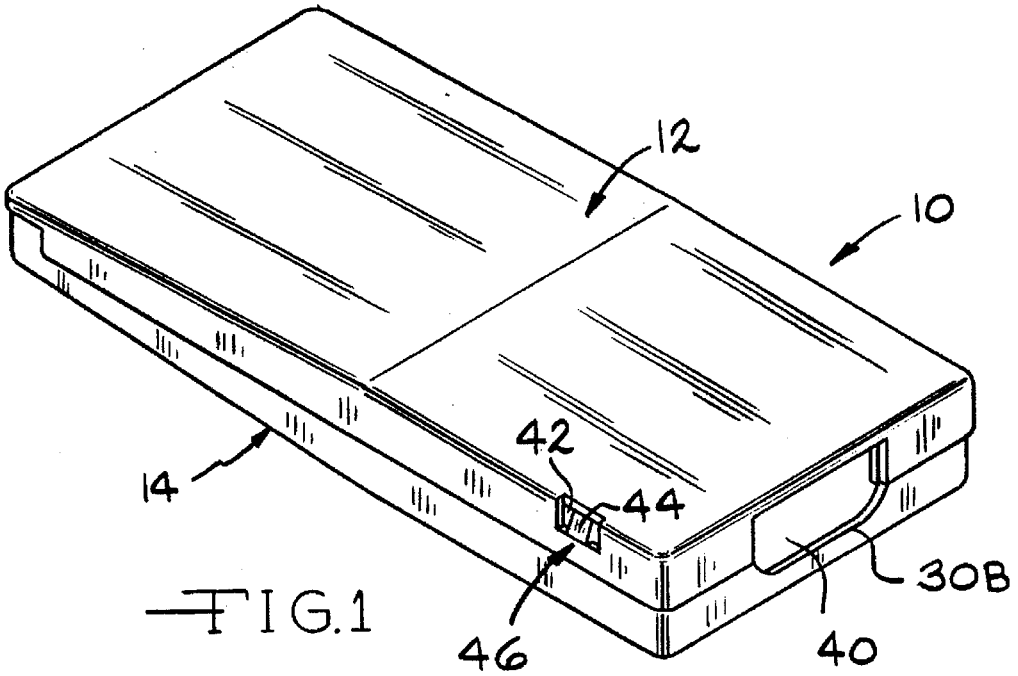
FIG. 1 is a perspective view of a paintbrush container 10 according to the present invention in the closed position.
Figure 2:
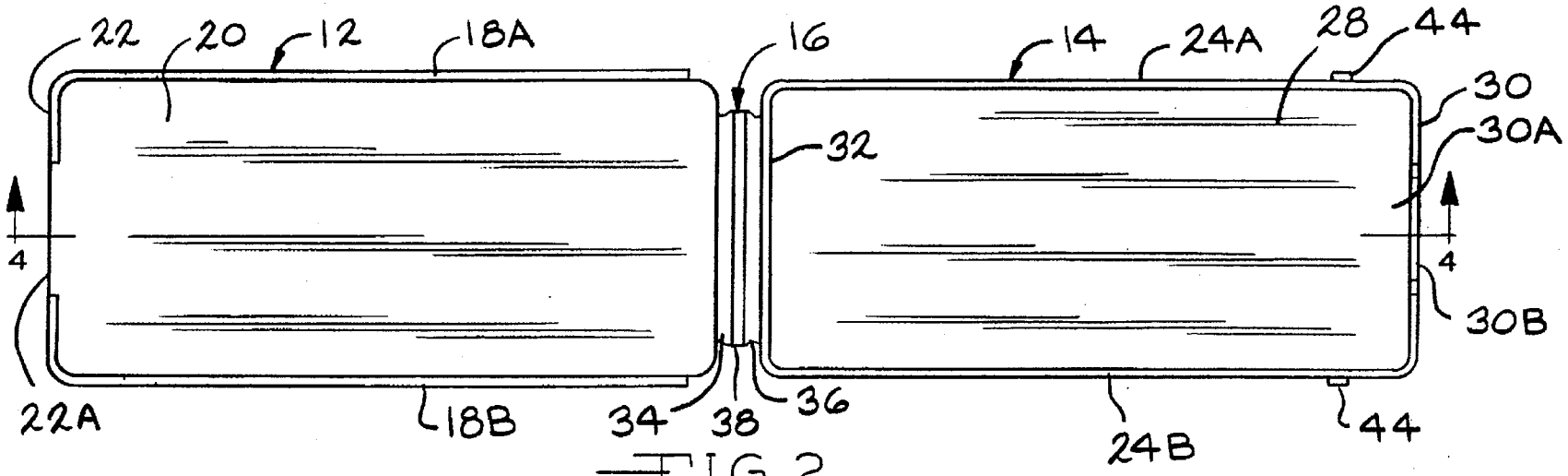
FIG. 2 is a plan view of the inside of the container 10 in the fully open position.

Referring now to the drawings, FIG. 1 shows a paint brush container 10 according to the present invention in its closed position and FIG. 2 shows the inside of the container 10 in its fully opened position. Container 10 is preferably of a resilient, thermoplastic material such as polypropylene and the like, and comprises a first or upper tray 12 and a second or lower tray 14 connected together by a hinge 16. Upper tray 12 includes a pair of opposed upper side walls 18A, 18B extending from an upper panel 20 and meeting an extending upper front wall 22. Front wall 22 is further provided with inlet 22A. Lower tray 14 comprises a pair of opposed lower side walls 24A, 24B extending from a lower panel 28 and meeting extending lower front and back walls 30 and 32, respectively. Lower front wall 30 is provided with inlet 30A partially defined by an upstanding ridge 30B provided for resting the handle of a paint brush thereon, as will be described in detail presently.

Figure 3:
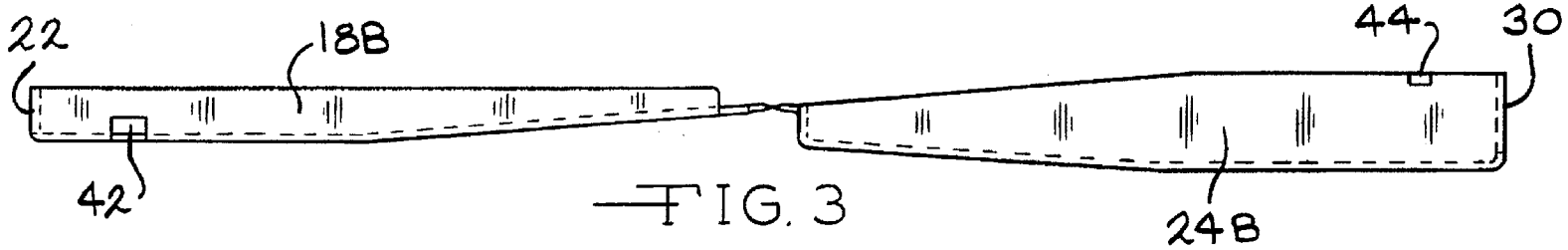
FIG. 3 is a side view of the container 10 in the fully open position.
Figure 4:
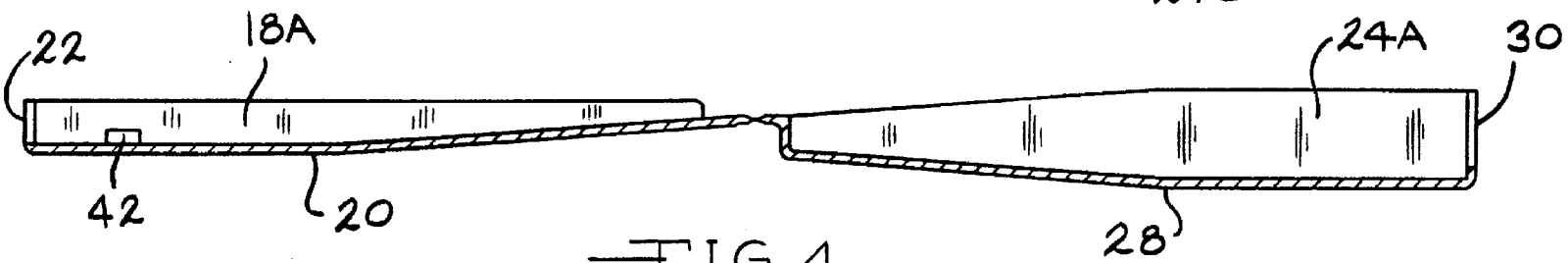
FIG. 4 is a longitudinal cross section view of the fully opened container 10 taken along line 4—4 in FIG. 2

Trays 12 and 14 are connected to each other by the living hinge 16. As particularly shown in FIG. 7, hinge 16 includes a web 34 which extends outwardly from panel 20 of upper tray 12 and is coplanar therewith. The lower tray 14 supports a web 36 which extends outwardly from the upper edge of the lower back wall 32 and joins web 34 at a pivot line 38 to thereby form hinge 16. Pivot line 38 of hinge 16 is continuous with webs 34 and 36, thus, providing for hinging motion of upper tray 12 with respect to lower tray 14 to move container 10 into an open position (FIGS. 2 to 4) and to close the container (FIGS. 1, 5 and 6).

Figure 5:
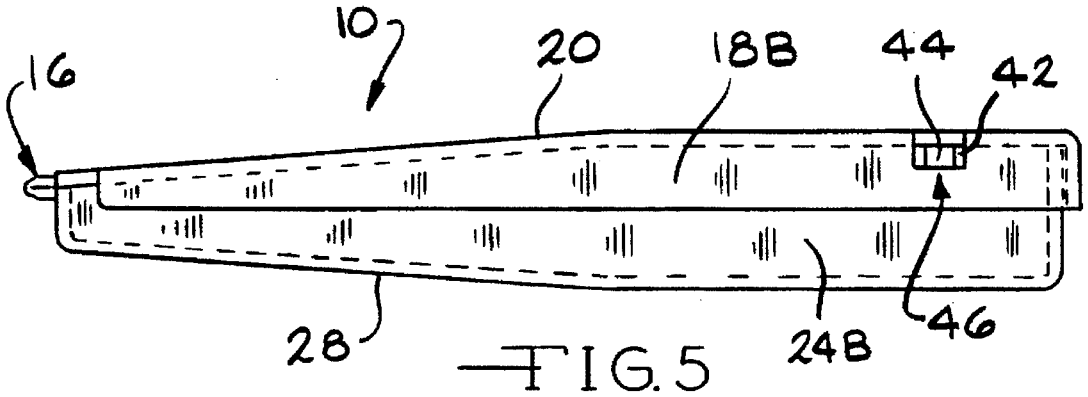
FIG. 5 is a side view of the container 10 in the closed position.
Figure 6:
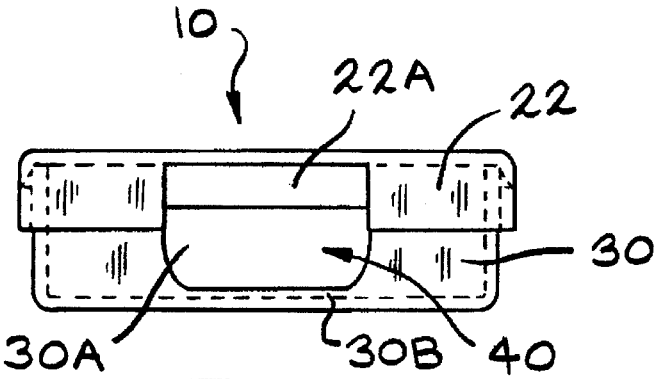
FIG. 6 is an end view of the container 10 showing the paint brush handle opening 40.

According to the present invention, tray 12 is somewhat wider and longer than tray 14 so that a portion of the side walls 24A, 24B, front wall 30 and back wall 32 of tray 14 fit within the perimeter of tray 12 with the container 10 in the closed position (FIGS. 5 and 6). Those skilled in the art will realize that with a paint brush (not shown) disposed within the closed container 10, the handle of the brush extends outwardly of the container through an opening 40 (FIG. 6) formed by inlets 22A and 30A in upper and lower front walls 22, 30, respectively, with the paint brush handle resting on ridge 30B.

As shown in FIGS. 1 and 3 to 5, receiving members in the form of openings 42 are provided through the side walls 18A, 18B adjacent to front wall 22 while protruding members 44 extend outwardly from the side walls 24A, 24B adjacent to front wall 30. The two pairs of openings 42 and protruding members 44 provide an effective fastener means to maintain the container in the closed position. When the lower tray 14 is moved into the closed position with a portion of its side walls surrounded by the perimeter of the side walls of the upper tray 12, the protruding members 44 are received within openings 42 to form two snap latch 46 closures (FIGS. 1 and 5), one at each corner of the closed container adjacent to brush handle opening 40.

It is an important aspect of the present invention that the length of the snap latch openings 42 along the longitudinal axis of container 10 is somewhat longer than the width of protruding members 44 along the same axis, as illustrated in FIGS. 1 and 5. After container 10 has been used for a period of time, pivot line 38 of hinge 16 may begin to wear and develop play. This play can be caused by the container being repeatedly moved between the open and the closed positions or simply form the container being subjected to rough treatment and the like. As a result of such wear, trays 12 and 14 may become somewhat out of the preferred alignment of the container in a new condition. This results in the displacement of the protruding members 44 from the position where they are normally received centered in openings 42 when the container 10 is new. If the openings 42 were only so large as to receive the protruding members 44 in a closely-fit relationship, it may become difficult to fastener the container 10 in the closed position. To do so would require the user to adjust the relative position of the trays 12, 14 to compensate for the play and properly align the protrusions 44 with the openings 42. However, in the present invention, the extended length of openings 42 provides for receiving the protruding members 44 even when the trays 12 and 14 are not perfectly aligned to thereby provide for easily securing the snap latches 46 to maintain the container 46 in the closed position.

Thus, in the preferred embodiment of the present invention, one protruding member 44 is provided on each of the opposed side walls 24A, 24B of the lower or second tray 14 and one fastener opening 42 is provided on each of the opposed side walls 18A, 18B of the upper or second tray 12. It is an advantage of the present invention that the container 10 is provided with two snap latches 46, each latch formed by one protruding member 44 and one opening 42 which quickly and easily mate with each other, even after the living hinge 16 is not new and has begun to wear. All that is needed to maintain the container closed is a slight pressing pressure on the trays 12, 14 adjacent to their respective front walls 22,30 with the protrusions 44 reliably and securely being received in the openings 42. In that respect, the snap latches 46 provide a reliable and secure fastening means for maintaining the container 10 in the closed position without having to take the time to ensure that protrusions 44 are centered in openings 42 before pressing the upper and lower trays 12 and 14 together. Furthermore, the resilient, thermoplastic material of container 10 provides for easily pulling the trays 12, 14 apart with the protrusions 44 resilient, releasing from the openings 42 to open the container 10 for accessing the paint brush housed therein.

It is appreciated that various modifications to the innovative concepts described herein may be apparent to those skilled in the art without departing from the spirit and the scope of the present invention defined by the hereinafter appended claims.

What is claimed is:

1. A paint brush container for maintaining the integrity of professional paint brushes, comprising:

a) a first tray having a first side wall extending from a relatively planar first panel, wherein the first side wall is provided with a first inlet;

b) a second tray having a second side wall extending from a relatively planar second panel, wherein the second side wall is provided with a second inlet facing the first inlet of the first tray;

c) a hinge connecting the first tray and the second tray for movement of the trays between an open container position and a closed container position with the first side wall of the first tray at least partially received in and surrounded by the second side wall of the second tray; and d) a fastener means comprising at least one fastener opening provided through the side wall of one of the first or the second trays adjacent to the respective first or second inlets and at least one mating protruding member provided on the other tray adjacent to the inlet of the other tray, wherein the length of the protruding member along the longitudinal axis of the container is less than that of the opening along the same longitudinal axis and wherein with the first and second trays in the closed position, the first and second inlets of the first and second trays provide a second opening for a paint brush handle and the first and the second trays are locked in the closed position with the protruding member mated in the fastener opening.

2. The paint brush container of claim 1 further including the first tray comprising:

a first panel having two opposed first side walls extending therefrom and a first front wall extending and connecting with the side walls, and wherein the second tray comprises a second panel having two opposed second side walls extending therefrom and meeting with a second front wall and a second back wall extending from the second panel and connecting to the two opposed second side walls, wherein with the first and second trays in the closed position, at least a portion of the walls of the second tray are surrounded by the walls of the first tray.

3. The paint brush container of claim 2 wherein the hinge further comprises:

i) a first hinge portion extending outwardly of the first tray and coplanar with the first panel;

ii) a second hinge portion extending outwardly from and perpendicular to the second back wall, coplanar with the second panel; and iii) a pivot line where the first hinge portion connects with the second hinge portion.

4. The paint brush container of claim 1 wherein the container is of a thermoplastic material.

5. The paint brush container of claim 4 wherein the thermoplastic material is polypropylene.

6. The paint brush container of claim 2 including one fastener opening provided on each of the first side walls that mates with protruding members provided on each of the second side walls.

* * * * *